United States Patent [19]

Gibson et al.

[11] Patent Number: 4,460,457

[45] Date of Patent: Jul. 17, 1984

[54] NAPHTHA REFORMING PROCESS

[75] Inventors: Kirk R. Gibson, El Cerrito; Robert J. Houston, San Rafael; Thomas R. Hughes, Orinda; Robert L. Jacobson, Hercules, all of Calif.

[73] Assignee: Chevron Research Company, San Francisco, Calif.

[21] Appl. No.: 178,658

[22] Filed: Aug. 18, 1980

[51] Int. Cl.[3] ..... C10G 35/06

[52] U.S. Cl. ..... 208/139

[58] Field of Search ..... 208/139

[56] References Cited

U.S. PATENT DOCUMENTS

| | | | |
|---|---|---|---|
| 2,902,434 | 9/1959 | Burton et al. | 208/134 |
| 3,005,770 | 10/1961 | Lutz | 208/140 |
| 3,438,888 | 4/1969 | Spurlock | 208/138 |
| 3,558,479 | 1/1971 | Jacobson et al. | 208/139 |
| 3,660,275 | 5/1972 | Carey et al. | 208/138 |
| 3,691,064 | 9/1972 | Hayes et al. | 208/139 |

*Primary Examiner*—Curtis R. Davis

*Attorney, Agent, or Firm*—S. R. La Paglia; W. K. Turner; Q. T. Dickinson

[57] ABSTRACT

In a process for reforming light naphtha with a bimetallic or multimetallic reforming catalyst, such as a platinum-rhenium-halogen catalyst, at conventional reforming conditions, wherein the catalyst is used for an extended continuous on-stream period, the aromatics selectivity of the catalyst is rapidly increased by contacting the naphtha and hydrogen with the catalyst at increased severity operating conditions, such as a reduced pressure less than 90% of the normal reforming pressure, during an initial portion of the on-stream period.

7 Claims, 2 Drawing Figures

ACCELERATED $C_5^+$ YIELD INCREASE WITH B-T FEED

NORMAL $C_5^+$ YIELD INCREASE

NAPHTHA REFORMING PROCESS

BACKGROUND OF THE INVENTION

The present invention concerns a process for reforming naphtha in the presence of hydrogen using a platinum-rhenium-halogen catalyst. The invention more particularly concerns a method for improving the aromatics selectivity of a reforming catalyst in an extended-cycle naphtha reforming process.

Catalytic reforming of naphthas in the presence of a hydrogen-rich gas is well known. Catalytic reforming is often employed for upgrading naphtha for motor fuel use. The octane increase obtained by reforming results primarily from conversion of lower octane naphthenes and aliphatics to higher octane aromatics. Catalytic reforming is also used commercially for producing specific desired aromatics, such as benzene, toluene or $C_8$ alkyl-aromatics, from light naphtha feeds boiling within the 100°–350° F. range, especially the 100°–250° F. range.

The relative selectivity of a naphtha reforming catalyst in converting nonaromatic feed hydrocarbons into mono cyclic aromatic hydrocarbons is an important commercial property of the catalyst. The relative selectivity of reforming catalysts may be measured by comparing the total amounts of monocyclic aromatic hydrocarbons produced from the same amounts of a naphtha feed at the same operating conditions. A more selective catalyst gives a higher total production of monocyclic aromatic hydrocarbons when feed flow rate and processing conditions are maintained at constant levels.

Commercial reforming catalysts become deactivated after a period of use in a reforming operation and must either be regenerated or replaced. Usually, one of three different reforming-regeneration systems are used in commercial reforming processes. The most widely used system is "extended-cycle", or "semi-regenerative", reforming, in which a fixed-bed charge of reforming catalyst is normally retained in continuous use in a reforming unit for an extended, continuous on-stream period without regeneration. At the end of the on-stream period, reforming is stopped and the catalyst charge is either replaced or regenerated in situ. The continuous on-stream period in a long-cycle reforming procedure is ordinarily longer than ten days, and typically lasts for about 6–24 months in the absence of a major upset or other unusual problems. Platinum-rhenium-halogen catalysts are widely used in extended-cycle reforming, and have been found to be active and stable over the long on-stream periods characteristic of extended-cycle reforming.

Two other reforming-regeneration systems used in commercial operations are (1) cyclic regenerative reforming and (2) continuous regenerative reforming. In cyclic regenerative reforming, a swing-bed type operation is used. Commonly, the catalyst in one reactor is being regenerated at any time and the remaining reactors (usually 3 or 4) are on-stream. Extra pipework and valving are provided so that any of the reactors can be regenerating while the others are in service. A typical on-stream period for a reactor used in a cyclic reforming procedure is about 1–10 days. In a continuous regeneration reforming procedure, portions of catalyst are continuously or periodically removed from the reforming reactor system, regenerated, and returned to the reactor system, while the reactor system remains on-stream in reforming use. Catalyst is removed and replaced essentially continuously, or at regular, closely-spaced intervals. Only a small portion of the catalyst is being regenerated at any given time. The catalyst charge in use in the reactor system at any given time includes both freshly regenerated catalyst and partially or wholly deactivated catalyst.

Cyclic and continuous reforming systems typically require a larger capital investment than long-cycle reforming. Cyclic and continuous procedures may also have high continuing utilities and operating expenses. The catalyst activity advantages of cyclic or continuous procedures are partially obviated when platinum-rhenium reforming catalysts are used, as such catalysts have superior activity stability and selectivity stability, and are well adapted for use in long-cycle reforming procedures.

Various ways for increasing the selectivity and/or stability of reforming catalysts have been suggested. Most of these have been attempts to solve the problem of maintaining a high level of catalyst activity stability in monometallic platinum catalysts, and thus are not particularly applicable to the treatment of platinum-rhenium reforming catalysts.

U.S. Pat. No. 2,838,446 describes alternating upgrading of heavy (300°–425° F.) naphtha and light (100°–300° F.) naphtha using a platinum-alumina catalyst. Treatment of the catalyst with light naphtha is asserted to restore catalyst activity. U.S. Pat. No. 2,868,718 describes preconditioning of a platinum-alumina catalyst before the catalyst is used in reforming by contacting it with a paraffinic naphtha. The preconditioning is said to render the catalyst less susceptible to deactivation during reforming. U.S. Pat. No. 2,876,195 describes pretreatment of a platinum-alumina catalyst before using it in reforming by treating the catalyst with a light, poison-free naphtha. The pretreatment is asserted to provide longer on-stream periods in reforming. U.S. Pat. No. 2,885,351 describes pretreatment of a platinum-alumina catalyst before using it in reforming by contacting the catalyst with a paraffinic or already reformed naphtha of relatively low end point at reforming conditions including a temperature of 15°–75° F. below the temperature to be used in the reforming operation. U.S. Pat. No. 2,902,434 describes the start-up of a reforming process using a platinum-alumina catalyst, including the initial addition of nitrogen, rather than hydrogen, to the feed to provide pressure, and the use of low temperatures until operating hydrogen pressure is reached autogenously in the process. U.S. Pat. No. 3,005,770 describes severe reforming of a $C_9$+ feed and separate, moderate reforming of a $C_6$–$C_8$ feed using platinum-alumina catalyst. After a particular catalyst charge is used in the severe reforming operation, it is then used in the moderate reforming operation. U.S. Pat. No. 3,024,187 describes preconditioning of a platinum-alumina reforming catalyst, especially one which is to be used in low pressure reforming, by operating for 10–100 hours at a pressure at least 50 psi higher than the pressure to be used during the reforming operation. The feed used during the preconditioning step can be the reforming feed or another hydrocarbon stream. U.S. Pat. No. 3,438,888 describes preconditioning a platinum-rhenium catalyst before using it in reforming by contacting the catalyst with a highly aromatic feed for at least 0.5 hour. The treatment is asserted to increase catalyst yield stability and to reduce initial hydrocracking. A feed containing polycyclic aromatics, and preconditioning pressure and temperature lower than the reforming pressure and temperature, are preferred. U.S. Pat. No. 3,660,275 describes a blocked operation for reforming using a platinum-alumina catalyst, in which a kerosene fraction is hydrogenated using the catalyst at a temperature of 500°-700° F. and the catalyst is then used for reforming a naphtha fraction. The patent teaches that the $C_5$+ yield in the reforming step decreases when the kerosene treatment step is used.

SUMMARY OF THE INVENTION

In an embodiment, the present invention relates to an improvement in a process for reforming a light naphtha by continuously contacting the feedstock and a hydrogen-containing gas with a catalyst including a platinum component, a rhenium component, and a halogen component on a porous solid carrier at naphtha reforming conditions including a reforming pressure between about 100 psig and about 500 psig, a reforming temperature of about 750° F. to 1100° F.; and a reforming hydrogen/hydrocarbon molar ratio of about 2 to about 10, the catalyst being used for an extended continuous on-stream period without regeneration, the improvement comprising: increasing the selectivity of the catalyst for forming monocyclic aromatic hydrocarbons from aliphatic hydrocarbons in the feedstock by contacting the naphtha and hydrogen-containing gas with the catalyst under increased severity conditions including at least one of (a) a reduced pressure not greater than 90% of the reforming pressure, (b) an increased temperature of 10° F. to 50° F. greater than the reforming temperature, and (c) a decreased hydrogen/hydrocarbon molar ratio of 40% to 80% of the reforming molar ratio, for about 2 hours to about 200 hours during an initial portion of the on-stream period.

In reforming light naphthas, the selectivity of a platinum-rhenium catalyst is relatively lower when the catalyst is new or freshly regenerated. The selectivity of the catalyst normally increases slowly during an initial portion of an extended, continuous operating period, until a substantially higher selectivity of conversion to monocyclic aromatics is reached. The selectivity then remains at an essentially constant level for the remainder of the running period. When conventional reforming conditions are maintained during the initial portion of the operating period, the slow increase in selectivity typically lasts 10 to 60 days, or longer, after start-up. With the total period of a continuous operation during the reforming run conventionally lasting 6 to 24 months, the initial period of increasing selectivity thus extends over an appreciable portion of the run. The overall yield of monocyclic aromatics is thus substantially less than that possible if the catalyst performed at the higher selectivity level for a longer fraction of the total running period.

We have found that the relatively slow rate of increase in catalyst selectivity during the initial part of the operating period can be substantially accelerated by operating under increased severity conditions such as a reduced pressure, e.g., less than 90% of the normal reforming pressure, for a period of 2-200 hours during the initial part of the continuous operating period. By accelerating the rate of increase in catalyst selectivity, so that highest selectivity is reached in a relatively short period of time at the start of the reforming run, the overall yield of monocyclic aromatics during an on-stream period is substantially increased, while overall production of undesirable by-products, such as $C_1$-$C_4$ hydrocarbons, is substantially decreased.

DESCRIPTION OF THE DRAWINGS

The attached drawings show data obtained in carrying out the invention in comparison to prior art processes, as further explained in the Detailed Description.

DETAILED DESCRIPTION OF THE INVENTION

Figure 1:
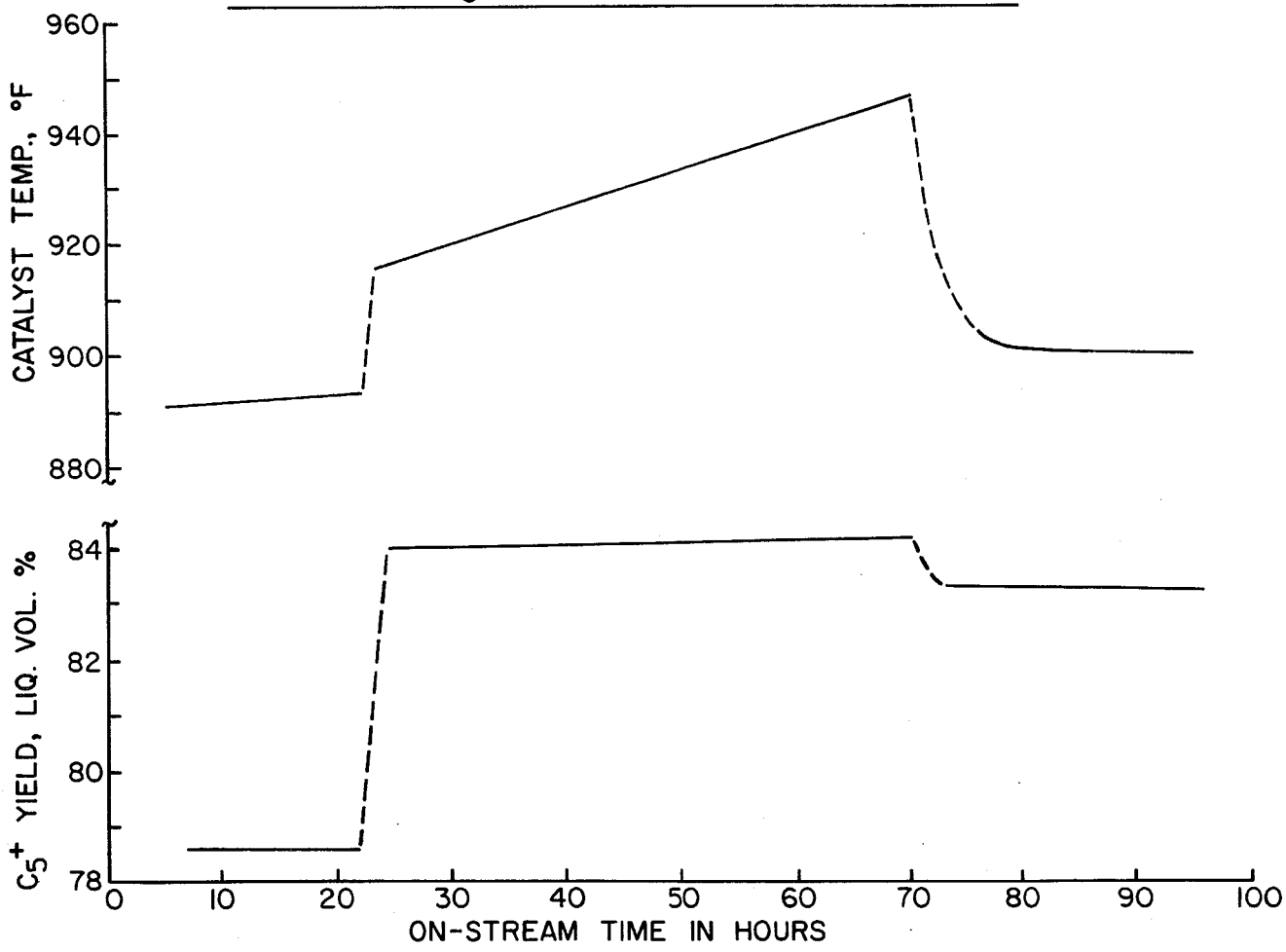

The improvement of the present invention is particularly adapted for use in processes for reforming light naphthas. Preferred light naphtha feedstocks are those normally boiling within the range from about 100° F. to about 350° F. Naphthas having a normal boiling range from about 100° F. to about 250° F. are especially preferred feedstocks. The present invention is especially useful in reforming the feedstocks conventionally employed in commercial benzene-toluene (BT) or benzene-toluene-xylenes (BTX) reforming operations. In BT or BTX reforming operations, it is usually desired to recover at least one specific aromatic compound, e.g., benzene, toluene or xylenes, from the reformate. Light naphthas with relatively narrow boiling ranges are used as feedstocks in BT and BTX operations in order to obtain relatively high concentrations of the desired aromatics, or aromatics, in the reformate, so that recovery of the desired products is more economical.

The present invention is utilized in reforming processes in which catalysts containing platinum, rhenium and halogen components are employed. Suitable platinum-rhenium catalysts include those widely used in commercial reforming processes and well known to those skilled in the art. Suitable catalysts include about 0.01-3 weight percent platinum, about 0.01-3 weight percent rhenium and about 0.1-5 weight percent halogen. The preferred halogen is chlorine, present as chloride, in an amount of about 0.5-2 weight percent of the catalyst. The platinum, rhenium and halogen components are present on the catalyst in association with a porous, solid catalyst carrier, such as a refractory inorganic oxide. A preferred carrier is alumina, especially gamma alumina. The catalyst may be prepared by any suitable method such as, for example, by impregnation of a calcined, particulate carrier with aqueous solutions of the platinum, rhenium and halogen, followed by further calcination and reduction. Suitable platinum-rhenium catalysts are commercially available.

The improvement of this invention is not particularly advantageous for use in reforming processes using platinum-halogen-alumina (monometallic) catalysts, such as the monometallic platinum reforming catalysts widely used commercially prior to the introduction of platinum-rhenium catalysts. Attempts to increase the aromatics selectivity of a platinum-only reforming catalyst by the present method have not been particularly successful.

The reforming conditions employed in an operation using the present invention are conventional and are generally well known to those skilled in the art. The naphtha feedstock and a hydrogen-containing gas are contacted with, for example, a platinum-rhenium-halogen reforming catalyst at a temperature in the range from about 750°-1100° F., a pressure in the range from about 100-500 psig, a hydrogen/hydrocarbon molar ratio in the range from about 2 to 10, and a hydrocarbon liquid hourly space velocity (LHSV) in the range from about 0.5 to 3.

A reforming operation using the invention is carried out during most of the on-stream period in a known manner, preferably by continuously comingling the naphtha feed with hydrogen or hydrogen-rich gas, heating the combined feed to the desired reforming temperature, and passing the heated feed through at least one reactor containing at least one bed of the platinum-rhenium catalyst. The effluent from a first reactor may be reheated and passed through a second reactor containing another bed of the reforming catalyst. The feed is passed through three or more reactors in series flow. After the mixture of naphtha reformate and hydrogen-rich gas is withdrawn from contact with the catalyst, the hydrogen-rich gas may be separated and preferably may be at least partially recycled for further use in the reforming operation. After the hydrogen is separated from the naphtha reformate product, the reformate may be stabilized to remove remaining light gases, such as $C_1$–$C_4$ hydrocarbons.

The present invention is particularly adapted for use in extended-cycle (semi-regenerative) type reforming operations. The invention permits the overall recovery of aromatics from a particular on-stream period to be substantially increased in reforming operations in which a platinum-rhenium catalyst is used continuously in reforming without regeneration for an extended on-stream period, typically longer than about 250 hours. Although sometimes useful in a swing-bed (cyclic) type reforming system, in which catalyst is typically used continuously for only 2–10 days between regenerations, the present invention is primarily useful in systems characterized by continuous use of catalyst for on-stream running periods on the order of several weeks to several months, or longer. Usually, the amount of catalyst deactivation encountered in carrying out the selectivity increase according to the invention makes its use in cyclic and continuous regeneration systems impractical.

In starting up a naphtha reforming system, circulation of inert gases, hydrogen, or other gas through the heaters, reactors, separators and recycle lines of the system is usually commenced prior to introduction of the naphtha feed into the system. Thereafter, the hydrocarbon feed is charged and the resulting product is normally analyzed to determine the quality of the product and the liquid ($C_5$+) product yield. Catalyst sulfiding may be done in one of several well known ways. Normally commercially used startup procedures can be employed in connection with the present invention. The reforming temperature used in this system is usually set according to the product quality so as to maintain a given aromatics concentration or octane number in the product. At given reforming conditions, a relatively constant aromatics concentration or octane number is achieved in the $C_5$+ reformate product. A target aromatics concentration or octane number is normally predetermined according to the specification requirements for the product, and the operating temperature in the reforming operation is then adjusted to obtain the desired aromatic concentration or octane number.

The selectivity of a catalyst for monocyclic aromatics is not necessarily indicated by the concentration, per se, of monocyclic aromatics in the $C_5$+ reformate. For example, in some cases, the concentration of monocyclic aromatics in the $C_5$+ reformate can be relatively high, even when the monocyclic aromatics selectivity of the catalyst is relatively low, if the catalyst is converting a relatively large fraction of the feed naphtha into undesirable, gaseous products, such as $C_1$–$C_4$ hydrocarbons. The selectivity of the catalyst for forming monocyclic aromatics is perhaps best indicated by the fraction of nonaromatics in the feed converted to product monocyclic aromatics, rather than simply by the concentration of monocyclic aromatics in the product. We have found that the selectivity of platinum-rhenium reforming catalysts in forming monocyclic aromatics from nonaromatics, when processing light naphtha feed, is relatively low at the start of a given on-stream period. During the course of the on-stream period operating under normal reforming conditions, the monocyclic aromatics selectivity of a platinum-rhenium catalyst exhibits slow, steady increase with time on-stream for several days or weeks. After this initial selectivity increase, the monocyclic aromatics selectivity of the catalyst remains essentially constant at a relatively high level for the remainder of the on-stream running period. The initial period of operation during which a slow monocyclic aromatics selectivity increase is normally observed, usually extends about 10 to 60 days from the beginning of a continuous on-stream running period. According to the invention, we have found that the monocyclic aromatics selectivity of platinum-rhenium catalysts can be increased to high, stable levels very rapidly by contacting the naphtha and hydrogen with the catalyst at high severity operating conditions such as a reduced pressure not greater than 90% of the normal pressure for a short period during initial operation. Preferably, a reduced pressure is between about 60% and 80% of the reforming pressure. Reforming operating parameters other than the decreased pressure, such as increased temperature, increased LHSV, etc., may also be used to increase the severity of operating conditions or can be maintained at normal operating levels.

When high severity is obtained by low pressure operation, the reduced pressure treatment is advantageously carried out before the end of the initial portion of the on-stream running (i.e., period before the catalyst has reached a high, stable level of monocyclic aromatics selectivity). It will be apparent that the most advantageous time to carry out a high severity operation, such as a reduced pressure treatment, is at or near the start of the reforming on-stream period. Of course, at least some benefits may be obtained by carrying out the high severity treatment any time before the monocyclic aromatics selectivity of the catalyst becomes stable.

By rapidly increasing the monocyclic aromatics selectivity of a platinum-rhenium catalyst through the use of the present invention, it is possible to obtain a high initial yield of monocyclic aromatics from a light naphtha feed. Accordingly, the total aromatics yield from a given amount of naphtha feed over the whole processing period is substantially increased relative to the total aromatics yield obtained when the selectivity of the platinum-rhenium catalyst increases in a slow, steady manner over a long period, under conventional operating conditions.

The high severity treatment of the invention is usually continued for a period in the range from about 2 to about 200 hours. Preferably a period within the range from 2 to 72 hours is used. When using low pressure to provide higher severity conditions, a relatively greater difference between the reduced pressure and the normal reforming pressure in a given system permits use of a relatively shorter high severity treatment time. For example, when the reduced pressure is 90% of the reforming hydrogen pressure, a treatment period of about 36–72 hours will generally be suitable, whereas at a reduced pressure of 70% of the reforming pressure, a treatment period of about 12–72 hours is quite suitable. It is preferred that a high severity operation be undertaken prior to the end of the first 250 hours of the on-stream period in the particular run. The high severity treatment is particularly preferably carried out prior to the end of the first 120 hours of the on-stream period. It is further preferred that a reduced pressure treatment employed to increase catalyst selectivity uses a pressure of about 40% to about 80% of the normal reforming pressure employed in the remaining on-stream period in the process. The ability to vary the pressure parameter will, of course, depend on the design of any particular reforming system.

In some cases, it may be advantageous to "line out" the reforming operation at steady state operation under the normal reforming conditions, including a normal reforming pressure, temperature and hydrogen/hydrocarbon molar ratio, before commencing the high severity treatment. This allows the flow rates and other variables in the reforming system to be controlled at the desired conventional level under known operating conditions prior to operation according to the invention. It may also be desirable to analyze the naphtha feed and reformate product in the reforming system to determine the rate of conversion to aromatics, prior to performing the low pressure treatment. Accordingly, while it is apparent that the high severity treatment should be performed at the start of an on-stream period or as shortly after the start of the on-stream period as possible, the high severity treatment need not be performed until after several days of conventional operation of a reforming unit to assure that the system is functioning normally.

Although the use of low pressure treatment to provide a high severity operation is preferred, adjustment of other variables in a reforming system can also be at least somewhat effective in accelerating the selectivity increase in a platinum-rhenium reforming catalyst. For example, by increasing the temperature about 10° F. to about 50° F. over the normal reforming temperature or by decreasing the hydrogen/hydrocarbon feed molar ratio to a ratio in the range from 40% to 80% of the normal ratio (in addition to any decrease incident to lower pressure), eg. by increasing the liquid hourly space velocity of the hydrocarbon feed without increasing the amount of hydrogen introduced into the feed before processing, it is possible to accelerate the increase in monocyclic aromatics selectivity of the catalyst. Increasing the temperature, decreasing the hydrogen/hydrocarbon feed molar ratio, or both, may be carried out in the alternative or in addition to the use of low pressure treatment. Increased temperature or reduced hyrogen/hydrocarbons ratio operating conditions, or both, may be used prior to, simultaneous with, or after, the low-pressure treatment, if desired. Advantageously, the low-pressure treatment can be performed while simultaneously increasing the temperature and reducing the hydrogen/hydrocarbon ratio, thereby providing sufficient operating severity to increase the monocyclic alkylaromatics selectivity of the catalyst to a high, stable level in the shortest possible fraction of the overall on-stream period.

EXAMPLES

Example I

Comparative tests were carried out on monometallic and bimetallic catalysts to show the effect of a short period of high severity treatment. Each catalyst was first lined out for 24 hours on a BT feed at normal reforming conditions (for the particular reforming system used) including 250 psig hydrogen pressure, 2 LHSV and 3.5 $H_2$/HC molar ratio, with the temperature adjusted to give 50 weight percent aromatics in the product. After lining out, each catalyst was subjected to a high severity conditioning for 48 hours at 100 psig hydrogen pressure, 7 LHSV and 1.75 $H_2$/HC molar ratio, with the temperature adjusted to give a 55 weight percent yield of aromatics in the product. After the high severity treatment, the normal reforming conditions were resumed. The results are shown in the Table.

TABLE

EFFECT OF HIGH SEVERITY TREATMENT ON $C_5$+ YIELD

| | Start of Run | | 24 Hours On-Stream | | After High Severity Treatment | |
|---|---|---|---|---|---|---|
| | Temp (°F.) | Product $C_5$+ (LV %) | Temp (°F.) | Product $C_5$+ (LV %) | Temp (°F.) | Product $C_5$+ (LV %) |
| Pt-Re/$Al_2O_3$ | 890 | 78.6 | 894 | 78.6 | 900 | 83.3 |
| Pt/$Al_2O_3$ | 908 | 75.0 | 908 | 80.0 | 930 | 81.4 |

Example II

Figure 2:
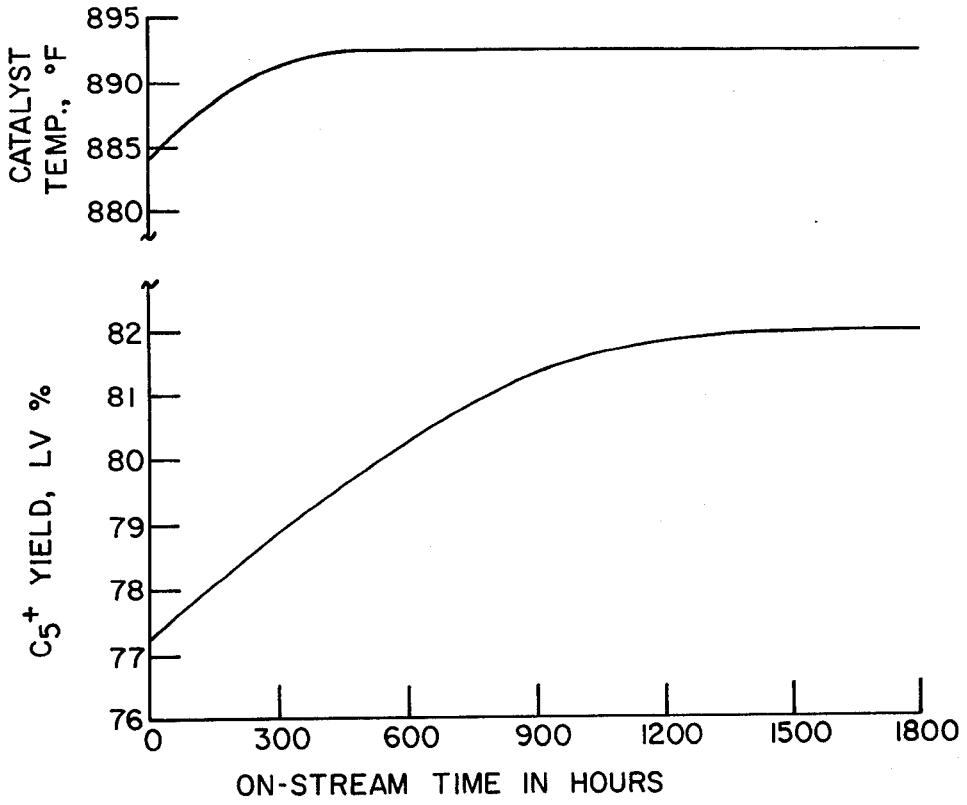

FIG. 1 shows the effect of a short, high severity treatment on a commercial PT-Re/$Al_2O_3$ catalyst. The catalyst was lined out on a BT feed for about 22 hours at normal reforming conditions (for the particular reforming system used) including a hydrogen pressure of 250 psig, 2 LHSV, 3.5 $H_2$/HC molar ratio, with temperature adjusted to give 50% aromatics in the product. Then the catalyst was subjected to a high severity treatment for about 46 hours at a total pressure of 100 psig, 7 LHSV, 1.75 $H_2$/HC molar ratio and temperature controlled to provide 55% aromatics in the product. After the high severity treatment, the normal reforming conditions were restored. The result was an increase of almost 5 volume percent in liquid $C_5$+ yield. FIG. 2 shows the normal slow increase in liquid $C_5$+ yield observed when normal reforming conditions are maintained throughout a run. The data used to develop FIG. 2 were obtained by reforming a $C_6$–$C_7$ naphtha at 250 psig total pressure using a commercial Pt-Re/$Al_2O_3$ catalyst, with temperature adjusted to give 95% conversion of methylcyclopentane. It will be observed that a stable, high $C_5$+ yield was obtained only after about 1200 hours on-stream. The difference in severity under normal operating conditions, (i.e., FIG. 1 data from 50% product aromatics, FIG. 2 data from 95% MCP conversion) results from use of different reforming units in the two tests. Adjusted for differences between these units, normal severity was essentially comparable in the two tests.

What is claimed is:

1. In a process for reforming a light naphtha feedstock by continuously contacting said feedstock and a hydrogen-containing gas with a catalyst including a platinum component, a rhenium component, and a halogen component on a porous solid carrier at naphtha reforming conditions including a preselected reforming pressure between about 100 psig and about 500 psig, a preselected reforming temperature of about 750° F. to 1100° F.; and a preselected reforming hydrogen/hydrocarbon molar ratio of about 2 to about 10, said catalyst being used for an extended continuous on-stream period without regeneration, the improvement comprising:

increasing the selectivity of said catalyst for forming monocyclic aromatic hydrocarbons from aliphatic hydrocarbons in said feedstock by contacting said naphtha and hydrogen-containing gas with said catalyst under increased severity conditions including at least one of (a) a reduced pressure not greater than 90% of said preselected reforming pressure, (b) an increased temperature of 10° F. to 50° F. greater than said preselected reforming temperature, and (c) a decreased hydrogen/hydrocarbon molar ratio of 40% to 80% of said preselected reforming molar ratio for about 2 hours to about 200 hours during an initial portion of said on-stream period.

2. A process according to claim 1 wherein said reduced pressure contacting is carried out for a period lasting about 2 to about 72 hours.

3. A process according to claim 1 wherein said reduced pressure is about 60% to about 80% of said reforming pressure.

4. A process according to claim 1 wherein the selectivity of said catalyst is increased by commencing said reduced pressure contacting prior to the end of a first 120 hours of said on-stream period.

5. A process according to claim 1 wherein said porous carrier is alumina.

6. A process according to claim 1 wherein said naphtha has a normal boiling range between about 100° F. and about 250° F.

7. The process of claim 1, wherein the reforming process is extended cycle reforming.

* * * * *